US006343966B1

(12) United States Patent
Martin et al.

(10) Patent No.: US 6,343,966 B1
(45) Date of Patent: Feb. 5, 2002

(54) MARINE PROPULSION SYSTEM HAVING A WATER PUMP DRIVEN BY AN ELECTRIC MOTOR

(75) Inventors: Chad W. Martin; Bret A. Martin, both of Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/689,023

(22) Filed: Oct. 12, 2000

(51) Int. Cl.[7] ..... B63H 21/10
(52) U.S. Cl. ..... 440/88.1
(58) Field of Search ..... 440/88.1

(56) References Cited

U.S. PATENT DOCUMENTS 3,908,579 A 9/1975 Miller et al.
4,016,825 A 4/1977 Pichl ..... 115/17
4,592,733 A 6/1986 Bland ..... 440/88
4,728,806 A 3/1988 Schneider ..... 440/1
4,832,639 A 5/1989 Karls et al. ..... 440/88
5,904,605 A 5/1999 Kawasaki et al. ..... 440/88

*Primary Examiner*—Jesus D. Sotelo
(74) *Attorney, Agent, or Firm*—William D. Lanyi

(57) ABSTRACT

A marine propulsion system is provided with an electric motor that drives a water pump. This arrangement allows an engine control unit to selectively change the speed of the electric motor and the water pump to suit operating conditions of the engine. Rather than driving the water pump directly from an output shaft of the internal combustion engine, it is driven by the electric motor which responds to signals provided by the engine control unit. These signals are preferably pulsed width modulated signals in which the duty cycle is changed to affect a change in the operating speed of the motor.

15 Claims, 2 Drawing Sheets

MARINE PROPULSION SYSTEM HAVING A WATER PUMP DRIVEN BY AN ELECTRIC MOTOR

BACKGROUND OF THE INVENTION

1. Field of the Invention

The present invention is generally related to a marine propulsion system and, more particularly, to a marine propulsion system that is able to control the operating speed of a water pump as a function of one or more measured parameters relating to the internal combustion engine of the marine propulsion system.

2. Description of the Prior Art

Various types of marine propulsion systems are well known to those skilled in the art. These include outboard motors, sterndrive systems which are also referred to as inboard/outboard drives, and inboard systems. When an internal combustion engine is used in combination with a marine propulsion system, some means must be provided to remove heat from the engine. Most marine propulsion systems draw water from the body of water in which the marine vessel is operated and conduct that water through a path which is in thermal communication with the internal combustion engine.

U.S. Pat. No. 4,728,306, which issued to Schneider on Mar. 1, 1988, discloses a marine propulsion auxiliary cooling system. The marine propulsion auxiliary cooling system is provided by an electric auxiliary water pump pumping sea water to cool the engine and/or fuel line after turning off the engine to prevent vaporization of the fuel, or in response to another given engine condition.

U.S. Pat. No. 3,908,579, which issued to Miller et al on Sep. 30, 1875, describes an outboard motor with a dual cooling system. The system defines a first water jacket system adjacent to first and second rotor cavities and having inlet and outlet ports. A housing assembly comprises wall surfaces which define aligned trochoid shaped rotor cavities and additional wall surfaces defining a water jacket system adjacent to other rotor cavities and having inlet and outlet ports. The system also comprises a water pump driven by the engine and having an inlet communicating with the water, and a water conduit communicating between the water pump and the water jacket system inlet ports.

U.S. Pat. No. 4,016,825, which issued to Pichl on Apr. 12, 1977, describes a device for driving a boat propeller and cooling water pump. The device for powering a propeller and a cooling water pump by a boat engine via a downwardly directed drive leg is disclosed in which it supports a hollow intermediate shaft for driving the propeller shaft. Between the crankshaft and the intermediate shaft there is arranged a reversible gear device. A shaft for powering the cooling water pump impeller is rigidly attached to the engine crankshaft and rotatably passes through the intermediate shaft to the impeller.

U.S. Pat. No. 4,592,733, which issued to Bland on Jun. 3, 1986, describes a water pump for a marine propulsion device. The marine propulsion device comprises an engine and a cooling jacket and a fuel pump assembly for circulating water through the cooling jacket. The fluid pump assembly comprises a housing including a pump chamber, an impeller within the housing, a driveshaft extending into the pump, means for rotating the driveshaft, and an interengaging means on the driveshaft and on the impeller for driving the impeller with the driveshaft so as to locate the driveshaft and the impeller in a single driving relation to each other.

U.S. Pat. No. 4,832,639, which issued to Karls et al on May 23, 1989, discloses a marine drive with air trap in auxiliary water inlet. A marine propulsion unit has a depending gearcase with one or more water inlet openings in the sides of the gearcase for supplying water to a water pump, and an auxiliary water inlet opening at an anti-ventilation plate above the propeller for supplying additional water to the water pump. The water passage from the auxiliary water inlet opening to the water pump has a portion extending downwardly below the level of the auxiliary water inlet opening and communicating with the side water inlet openings. When the side water inlet openings are below the water line and the auxiliary water inlet is above the water line, water is received in the downwardly extending portion of the second passage and blocks air from flowing from the auxiliary inlet opening to the water pump, to prevent engine overheating.

U.S. Pat. No. 5,904,605, which issued to Kawasaki et al on May 18, 1999, describes a cooling apparatus for an outboard motor. The apparatus is provided with a water-cooled engine in a vertical alignment in which a crank shaft is vertically disposed, the engine being composed of a cylinder block, a cylinder head and an exhaust manifold into which water jackets are formed respectively and the water jackets are supplied with cooling water from a water pump disposed below the engine in a state mounted to a hull, the cooling apparatus comprising a cylinder cooling-water passage for supplying cooling water from the water pump to the water jackets of the cylinder block and the cylinder head, an exhaust cooling-water passage for supplying cooling water from the water pump to the water jacket of the exhaust manifold, the cylinder cooling-water passage and the exhaust cooling-water passage being independently disposed from each other and being joined together at downstream portions thereof, a thermostat providing for the water jacket of the cylinder block and a sensor for detecting a temperature of the cylinder surface provided for the water jacket of the cylinder block at a portion between the water jacket thereof and the thermostat.

The patents described above are hereby expressly incorporated by reference in the description of the present invention.

In most known marine propulsion systems, the water pump is driven mechanically and directly by the drive shaft of the system. Therefore, the rotatable portion of the water pump is constantly turning at a rate determined by the speed of the drive shaft. Depending on the particular sizes of the conduits and orifices associated with the cooling system of the engine and depending on the speed of the engine, these known systems often deliver more cooling water to the engine cooling system than is needed under normal conditions. Excess water is commonly conducted to the exhaust system of the engine. If more water is being pumped from the body of water in which the vessel is operating than is needed for removing heat from the engine and its exhaust system, certain components can be cooled to temperatures that are below their optimum levels. Thermostats can be used to regulate the amount of water flowing directly into the engine cooling system, but excess water pumped by the water pump must then be conducted back to the body of water in some manner and along some path. Typically, excess water is conducted into the exhaust system of the engine. As a result, certain regions of the marine propulsion system can be cooled to temperatures below their optimum magnitudes. Furthermore, if more water is being pumped by the water pump than is needed by the internal combustion engine for purposes of removing heat, power is wasted by pumping excess water that is not actually needed or used. It would therefore be significantly beneficial if a water cooling system could be provided for a marine propulsion system which draws only the amount of water from the body of water that is needed to maintain the optimum operation of the internal combustion engine and its exhaust system.

SUMMARY OF THE INVENTION

A preferred embodiment of the present invention provides a marine propulsion system which comprises an internal combustion engine having a liquid cooling system and a drive unit of the marine propulsion system which is at least partially submersible in a body of water in which the marine propulsion system is operable. The drive unit is connected in torque transmitting relation with an output shaft of the internal combustion engine.

A water pump, located within the drive unit, has a water inlet and a water outlet. The water inlet is disposable in fluid communication with the body of water in which the marine vessel is operated and the water outlet is disposed in fluid communication with the liquid cooling system of the internal combustion engine. By using this arrangement, the water pump can draw water from the body of water in which a marine vessel is operated and cause that water to be pumped toward and into the cooling system of the internal combustion engine. An electric motor is provided with a rotor connected in torque transmitting relation with the rotatable member of the water pump. The water pump can be a vane pump in which a rotor having a plurality of vanes is rotated within a stator to pump water from the body is of water toward and through the liquid cooling system.

The present further comprises an engine controller connected in signal communication with the electric motor and a first sensor connected in signal communication with the engine controller. The engine controller controls the operating speed of the electric motor as a function of a first parameter sensed by the first sensor. In a typical application of the present invention, the first sensor is a temperature sensor and the first parameter is an engine coolant temperature. The engine coolant temperature can be measured within an internal passage of the engine's cooling system. If the engine cooling system is a closed system, in which sea water is passed in thermal communication with a coolant contained within a closed system, the temperature of the coolant within the closed system can be used for the purposes of the present invention and can be sent by the first sensor. The engine controller controls the operating speed of the electric motor by transmitting pulse width modulated (PWM) signals to the electric motor in a preferred embodiment of the present invention.

The present invention can further comprise a second sensor connected in signal communication with the engine controller, wherein the engine controller controls the operating speed of the electric motor as a function of both the first parameter sensed by the first sensor and a second parameter sensed by the second sensor. The second sensor can be a tachometer and the second parameter can be engine speed. In certain embodiments, the engine controller can control the speed of the electric motor, and therefore the speed of the pump, as a dual function of both engine speed and coolant temperature. The marine propulsion system can be a sterndrive system and, in a preferred embodiment, the engine controller can comprise a microprocessor.

BRIEF DESCRIPTION OF THE DRAWINGS

The present invention will be more fully and completely understood from a reading of the description of the preferred embodiment of the present invention in conjunction with drawings, in which.

DESCRIPTION OF THE PREFERRED EMBODIMENT

Figure 1:
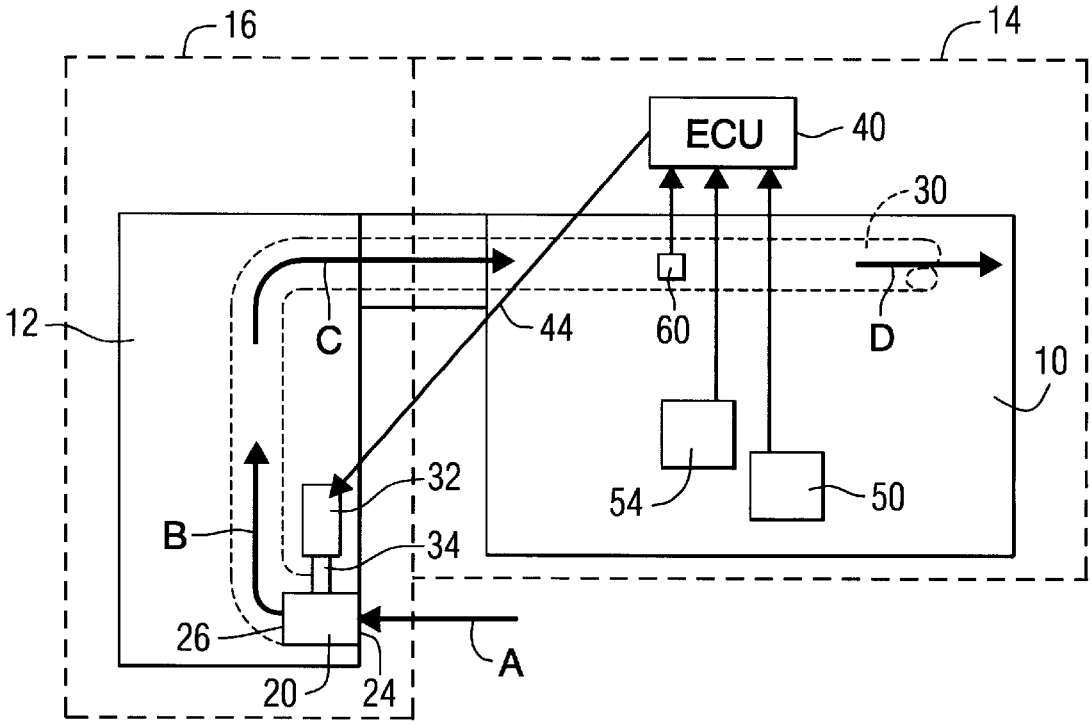
FIG. 1 shows a marine propulsion system made in accordance with the present inventions.

Throughout the description of the preferred embodiment of the present invention, like components will be identified by like reference numerals.

FIG. 1 is a schematic representation of a marine propulsion system which comprises an internal combustion engine 10 and a drive unit 12. Dashed box 14 encloses the portion of the marine propulsion system that would typically be located within the structure of a marine vessel forward of its transom. Dashed box 16 encloses the drive unit that is typically located aft of the transom. The simplified schematic representation of FIG. 1 is intended to illustrate the operation of the present invention in conjunction with a sterndrive system. However, it should be understood that an outboard motor configuration can also be used in conjunction with the present invention.

In FIG. 1, a water pump 20 is disposed within the drive unit 12 and has a water inlet 24 and a water outlet 26. The water inlet 24 is disposable in fluid communication with a body of water in which the marine vessel is operated and the water outlet 26 is disposed in fluid communication with the liquid cooling system 30 of the internal combustion engine 10. The liquid cooling system 30 of is the internal combustion engine 10 is represented by the dashed line conduit in FIG. 1, but it is well known to those skilled in the art that the liquid water cooling system 30 typically comprises numerous passages and cavities within an engine block and one or more water jacket surrounding heat producing portions of the engine 10. For purposes of clarity and simplicity, the engine cooling system 30 is represented by a simple conduit illustrated by dashed lines in FIG. 1. Arrow A represents water flowing from the body of water in which the marine vessel is operated and into the water inlet 24 of the water pump 20. Arrow B represents the water flowing from the water outlet 26 of the water pump 20 and toward the cooling system 30 of the engine 10. Similarly, arrows C shows the water flowing through the area of the transom of the marine vessel and into the cooling system 30 from which the water flows, as represented by arrow D, into the various passages and water jackets of the engine 10.

An electric motor 32 has a rotor 34 which is connected in torque transmitting relation with a rotatable member of the water pump 20. The rotatable member is typically a vaned rotor of the water pump 20 and rotates in coordination with the rotor 34 of the electric motor 32. An engine control unit (ECU) 40, or engine controller, is connected in signal communication with the electric motor 32, as represented by arrow 44. A first sensor 50 is connected in signal communication with the engine controller 40 and the engine controller 40 controls the operating speed of the electric motor 32 as a function of a first parameter sensed by the first sensor 50. In a typical application of the present invention, the first sensor 50 is a temperature sensor and is disposed in thermal communication with some part of the cooling system 30 of the engine 10 to monitor the temperature of the coolant within the engine block. The engine control unit 40 can provide modulated signals on line 44 to the electric motor 32 to control its operating speed and, in turn, control the operating speed of the water pump 20. A second sensor 54 can be connected in signal communication with the engine controller 40, as shown in FIG. 1, and the engine controller can control the operating speed of the electric motor 32 as a dual function of both the first parameter sensed by the first sensor 50 and the second parameter sensed by the second sensor 54. As discussed above, the first sensor 50 can be a temperature sensor. The second sensor 54 can be a tachometer which monitors the operating speed of the internal combustion engine 10. The engine control unit 40 typically comprises a microprocessor or microcomputer which performs various functions determined by an algorithm or coded program within its memory.

With continued reference to FIG. 1, a flow sensor 60 is shown disposed within a portion of the cooling system 30 to monitor the actual measured rate of coolant flow through the system. The flow system 60 can be a safety monitor to assure that cooling water is actually flowing through the system, regardless of the intended operation of the water pump 20. In other words, even though the water pump 20 and the electric motor 32 can be operating properly, a blockage in the system could possibly prevent water from actual flowing through the liquid cooling system 30 and, as a result, the engine 10 could overheat. In addition, even though the engine control unit 40 is providing signals on line 44 to the electric motor 32, a failure in any one of the components can cause the water flow through the cooling system 30 to stop. In other words, the electric motor 32 can fail or the water pump 20 can jam. In addition, a shaft 34 connecting the electric motor 32 to the water pump 20 can break. The flow sensor 60 provides a convenient check on the overall operation of the engine.

Figure 2:
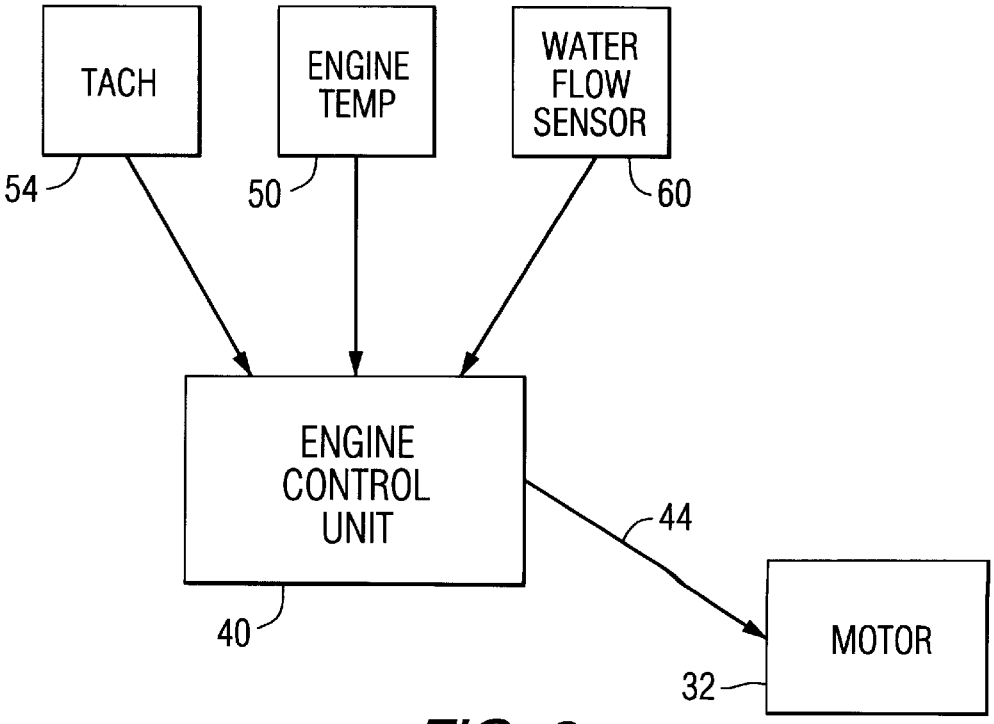
FIG. 2 is a schematic representation of the primary components of the present invention and their signal exchange relationships.

FIG. 2 is a schematic representation of the components of the present invention, including the engine control unit (ECU) 40, the water flow sensor 60, the engine temperature sensor 50, or first sensor, and the tachometer 54, or second sensor. The engine control unit 40 receives signals from the tachometer 54, the engine temperature sensor 50 and the water flow sensor 60 and, based on these signals, determines an appropriate pulse width modulated (PWM) signal to be sent to the motor 32 on line 44. In a highly simplified version of the present invention, the engine control unit 40 can determine the appropriate speed of the motor 32, and therefore the water pump 20, based solely on the magnitude of the temperature of the liquid cooling system 30, as measured by the engine temperature sensor 50. In this type of simple system, the speed of the motor 32 would be increased to cause increased flow through the water pump 20 if the temperature of the cooling system is sensed as being greater than a preselected value. Similarly, if the temperature of the cooling system 30 is sensed to be lower than a preselected value, the speed of the motor 32 can be slowed to allow the engine temperature to rise to a desired range. This allows the engine to be operated within a desirable range for optimum engine performance regardless of the temperature of the water, the speed of the engine 10, or other factors affecting the temperature of the coolant within the liquid cooling system 30. In a slightly more complex embodiment of the present invention, the engine control unit 40 can monitor both engine speed and engine temperature, as measured by the tachometer 54 and engine temperature sensor 50, and determining an appropriate operating speed of the motor 32 based as a dual function on both of these parameters. This can be easily accomplished by providing a two dimensional matrix in the memory of the engine control unit 40 in which an allowable temperature range is divided into a discrete number of steps and an allowable pressure range is also divided into a discrete number of steps. A number of numeric entries in the matrix is determined by the number of temperature steps multiplied by the number of pressure steps. Each one of these entries in the two dimensional array represents a desirable operating speed of the motor 32. Naturally, at higher temperatures and higher engine operating speeds, the speed of the motor 32 would be raised to assure an adequate flow of coolant through the liquid cooling system 30 of the engine 10. At lower temperatures and lower operating speeds, the speed of the motor 32 could be slower.

Figure 3:
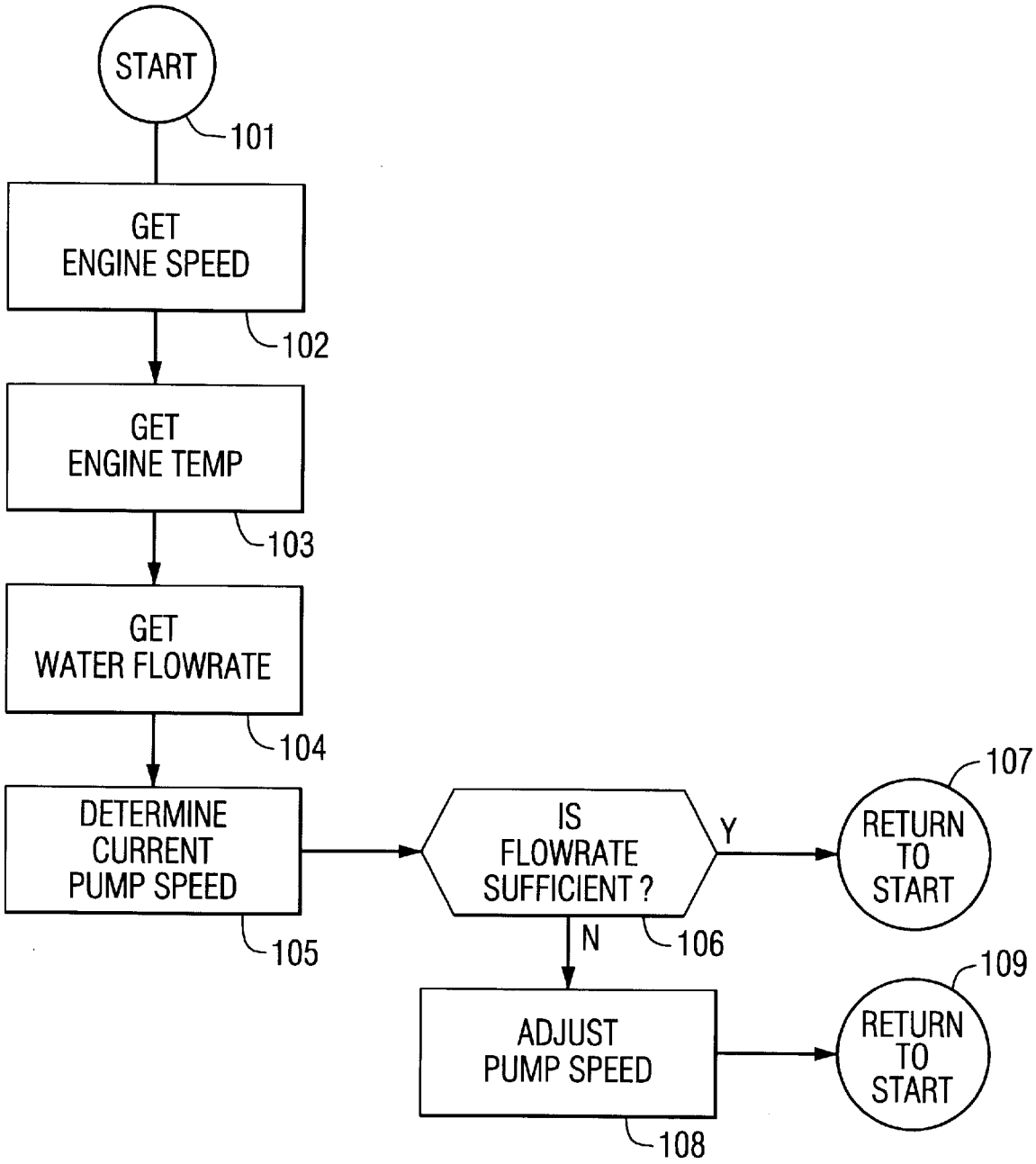
FIG. 3 is exemplary flow chart that can be used by an engine control unit of the present invention.

FIG. 3 shows a flow chart that can represent a typical algorithm or software program to be followed by the program within the engine control unit 40. At a start point represented by functional block 101, the engine control unit gets an engine speed magnitude from the tachometer 54 at functional block 102, an engine temperature magnitude from the engine temperature sensor 50 at functional block 103, and a flow rate from the flow sensor 60 at functional block 104. These three steps can be simple data access steps in which the most recent signals provided by the three sensors can be accessed and stored by the software program. At functional block 105, the current pump speed is determined. This can be the simple step of accessing the most recent pulse width modulating digital value that was most recently transmitted on line 44 to the motor 32. Alternatively, a speed sensor associated with the motor 32 can be read to determine the actual speed of the motor 32.

At functional block 106, the engine control unit 40 makes a decision regarding whether or not the current flow rate is sufficient. These can be accomplished by first determining a desired flow rate as a function of the engine speed and the engine temperature, by using a two dimensional array or look-up table, as determined at functional blocks 102 and 103, and then comparing the desired pump speed to the actual pump speed. Alternatively, the water flow rate value determined at functional block 104 can be compared to a desired flow rate value determined as a function of engine speed and engine temperature. Regardless of the precise details in the method of making the determination at functional block 106, the sufficiency of the flow rate is determined. If it is sufficient (i.e. within an allowable range of the desired speed), the program continues to functional block 107 and returns to the start 101. If the flow rate is determined as not being sufficient (i.e. out of the allowable range), the pump speed is adjusted at functional block 108. This adjustment can be a change in the output on line 44 to the electrical motor 32. After this is accomplished, the program continues to functional block 109 and returns to the start of functional block 101.

The primary advantage of the present invention is that the variable speed of the motor 32 allows the present invention to determine the rate at which water will be pumped from the body of water in which the vessel is operated and into the cooling system of the engine. In known systems, the rate of water pumping is determined solely as a function of engine speed and is not variable based on operating conditions, such as temperature. The present invention allows the marine propulsion system to be operated more efficiently by avoiding the unnecessary pumping of excess cooling water from the body of water as is typical in known systems.

Although the present invention has been described with considerable detail and illustrated to show one embodiment of the present invention, it should be understood that alternative embodiments are also within its scope.

We claim:

1. A marine propulsion system, comprising:

an internal combustion engine having a liquid cooling system;

a drive unit of said marine propulsion system which is at least partially submersible in a body of water in which said marine propulsion system is operable;

a water pump, within said drive unit, having a water inlet and a water outlet, said water inlet being disposable in fluid communication with said body of water and said water outlet being disposed in fluid communication with said liquid cooling system of said internal combustion engine;

an electric motor having a rotor connected in torque transmitting relation with a rotatable member of said water pump;

an engine controller, comprising a microprocessor, which is connected in signal communication with said electric motor; and a first sensor connected in signal communication with said engine controller, said engine controller controlling the operating speed of said electric motor as a function of a first parameter sensed by said first sensor.

2. The system of claim 1, wherein:

said first sensor is a temperature sensor and said first parameter is an engine coolant temperature.

3. The system of claim 1, wherein:

said engine controller controls the operating speed of said electric motor by transmitting pulse width modulated signals to said electric motor.

4. The system of claim 1, further comprising:

a second sensor connected in signal communication with said engine controller, said engine controller controlling the operating speed of said electric motor as a function of both said first parameter sensed by said first sensor and a second parameter sensed by said second sensor.

5. The system of claim 4, wherein:

said second sensor is a tachometer and said second parameter is engine speed.

6. The system of claim 1, wherein:

said marine propulsion system is a stern drive system.

7. A marine propulsion system, comprising:

an internal combustion engine having a liquid cooling system;

a drive unit of said marine propulsion system which is at least partially submersible in a body of water in which said marine propulsion system is operable;

a water pump, within said drive unit, having a water inlet and a water outlet, said water inlet being disposable in fluid communication with said body of water and said water outlet being disposed in fluid communication with said liquid cooling system of said internal combustion engine;

an electric motor having a rotor connected in torque transmitting relation with a rotatable member of said water pump;

an engine controller connected in signal communication with said electric motor;

a first sensor connected in signal communication with said engine controller, said engine controller controlling the operating speed of said electric motor as a function of a first parameter sensed by said first sensor; and a second sensor connected in signal communication with said engine controller, said engine controller controlling the operating speed of said electric motor as a function of both said first parameter sensed by said first sensor and a second parameter sensed by said second sensor.

8. The system of claim 7, wherein:

said first sensor is a temperature sensor;

said first parameter is an engine coolant temperature;

said second sensor is a tachometer; and said second parameter is engine speed.

9. The system of claim 8, wherein:

said engine controller controls the operating speed of said electric motor by transmitting pulse width modulated signals to said electric motor.

10. The system of claim 9, wherein:

said marine propulsion system is a stern drive system.

11. The system of claim 10, wherein:

said engine controller comprises a microprocessor.

12. A marine propulsion system, comprising:

an internal combustion engine having a liquid cooling system;

a drive unit of said marine propulsion system which is at least partially submersible in a body of water in which said marine propulsion system is operable;

a water pump, within said drive unit, having a water inlet and a water outlet, said water inlet being disposable in fluid communication with said body of water and said water outlet being disposed in fluid communication with said liquid cooling system of said internal combustion engine;

an electric motor having a rotor connected in torque transmitting relation with a rotatable member of said water pump;

an engine controller connected in signal communication with said electric motor;

a first sensor connected in signal communication with said engine controller, said engine controller controlling the operating speed of said electric motor as a function of a first parameter sensed by said first sensor; and a second sensor connected in signal communication with said engine controller, said engine controller controlling the operating speed of said electric motor as a function of both said first parameter sensed by said first sensor and a second parameter sensed by said second sensor, said first sensor being a temperature sensor, said first parameter being an engine coolant temperature, said second sensor being a tachometer, and said second parameter being engine speed.

13. The system of claim 12, wherein:

said engine controller controls the operating speed of said electric motor by transmitting pulse width modulated signals to said electric motor.

14. The system of claim 13, wherein:

said marine propulsion system is a stern drive system.

15. The system of claim 14, wherein:

said engine controller comprises a microprocessor.

* * * * *